United States Patent [19]

Krasser

[11] 4,167,720

[45] Sep. 11, 1979

[54] CIRCUIT BREAKER WITH SWITCHING ROCKER

[75] Inventor: Fritz Krasser, Altdorf, Fed. Rep. of Germany

[73] Assignee: Ellenberger & Poensgen GmbH, Altdorf, Fed. Rep. of Germany

[21] Appl. No.: 903,672

[22] Filed: May 8, 1978

[30] Foreign Application Priority Data

May 11, 1977 [DE] Fed. Rep. of Germany ..... 2721162

[51] Int. Cl.[2] ..... H01H 71/16

[52] U.S. Cl. ..... 337/60; 337/74; 337/350; 337/356

[58] Field of Search ..... 337/58–60, 337/52, 70, 72, 334, 350, 356, 74

[56] References Cited

U.S. PATENT DOCUMENTS

| | | | |
|---|---|---|---|
| 2,362,850 | 11/1944 | Platz | 337/58 X |
| 3,932,829 | 1/1976 | Ellenberger | 337/75 X |

*Primary Examiner*—R. L. Moses

*Attorney, Agent, or Firm*—Spencer & Kaye

[57] ABSTRACT

A circuit breaker composed of a contact spring fixed at one end, carrying a movable contact at its free end and biassed to urge the movable contact away from an associated fixed contact, a switching rocker pivotally mounted to selectively move the spring into a contact closing position, and a release device arranged to move the spring into the contact opening position independently of the position of the rocker, is further provided with a latching lever which extends approximately parallel to the contact spring, is mounted to be pivotal in a direction parallel to the direction of movement of the spring and of the rocker, and is operatively connected between the spring, the rocker and the release device.

20 Claims, 8 Drawing Figures

CIRCUIT BREAKER WITH SWITCHING ROCKER

BACKGROUND OF THE INVENTION

The present invention relates to a circuit breaker of the type including a contact spring having a fixed end clamped into the switch housing and a free end provided with a movable contact which is arranged to cooperate with a fixed contact, the spring being biassed to urge the movable contact away from the fixed contact, as well as a switching rocker which acts on the spring and a release device responsive to a current overload.

In such a circuit breaker, the rocker is arranged to selectively move the spring into a contact closing position and is mounted in the breaker housing to be pivoted about an axis extending approximately perpendicular to the spring for movement between a breaker opening position and a breaker closing position. The release device acts to permit the spring to execute a contact opening movement independently of the position of the rocker.

In such switches, switching off should take place automatically, in dependence on the occurrence of an excess current, even if the switching rocker is being retained in its switch closing position, a trip-free release should be effected.

SUMMARY OF THE INVENTION

It is an object of the present invention to provide a switch of the above-mentioned type which has a structure that can be produced as easily and economically as possible and is efficient in operation.

These and other objects are achieved according to the present invention: by providing such a circuit breaker switch with a latching lever which extends approximately parallel to, and adjacent, the contact spring and is pivotally mounted within the housing, the lever resting against the back of the contact spring and having a contact end which faces the free end of the spring so as to be displaceable in approximately the direction of switch opening movement of the movable contact, the lever having a detent end which rests against a detent abutment that can be moved out of engagement with the detent end by actuation of the release device; by disposing the switching rocker at the side of the latching lever which is remote from the spring; and by providing the switching rocker with an active end which protrudes toward the latching lever, and which lies in each rocker position, at a respectively different side of a line perpendicular to the latching lever and passing through the axis of the switching rocker, and which, in the breaker closing position of the rocker, presses the latching lever into its position in which it closes the contacts and its detent end is in a position to rest against the detent abutment.

The switch according to the invention is distinguished by a relatively compact structure, with its main components essentially disposed one above the other in the pivot plane of the switching rocker. The pivot axes are all perpendicular to the pivot plane of the switching rocker, which enables the switch to be installed with ease.

According to preferred embodiments of the invention, the active end of the rocker rests, in the closing position of the rocker, in a first detent recess provided in the latching lever, so that the switching rocker, whose active end produces the contact pressure when it is in the closing position, will not inadvertently be changed from that position to the opening position, for example by the counterpressure of the contact spring. This feature is of significance particularly when the rocker is under the influence of a resetting force which urges it into its breaker opening position.

In further accordance with preferred embodiments of the invention, the latching lever presents a cam path which includes the first detent recess and along which the active end of the switching rocker travels when moving between its positions, the cam path has a projection located in the vicinity of the center dead point of the active end and protruding toward the switching rocker axis, and the cam path includes a second detent recess in which the active end of the rocker rests, in the opening position of the rocker, and which is located at a greater distance than the first recess from the rocker axis. This assures that the active end of the switching rocker, when the rocker is in its opening position, is unable to exert any contact pressure on the contact spring via the latching lever.

Preferably, in the above-described embodiment, the active end of the rocker effectively terminates in a laterally protruding guide projection which rests on the cam path, and the the cam path is defined by a guide groove which is closed on all sides and which guides the projection. This has the result that transfer of the switching rocker from the closing position to the opening position raises the detent end of the latching lever so that the detent abutment can return unimpededly to its respective starting position.

In embodiments of the invention, the release device includes a release lever which also provides the abutment and which is subjected to a resetting force which urges it in the direction opposite to that required to release the spring so as to bring the abutment into position to engage the latching lever. This permits automatic return of the detent abutment into its starting position once the element responsive to a current overload, e.g., a bimetal strip has cooled and as soon as the detent end of the latching lever has been raised.

The release lever can be an angular, or bell crank, lever one arm of which is acted on by the overload responsive element and extends approximately parallel to the contact spring and/or the latching lever, so that the release lever pivots in the same plane as the switching rocker. Favorable lever ratios are achieved when the one arm of the release lever is approximately of the same length as the contact spring and/or the latching lever, and a simple structure effecting automatic return of the detent abutment into its starting position, when the detent end of the latching lever is raised and the overload responsive element has cooled, is provided when the other arm of the angular release lever extends approximately parallel to lateral housing walls and the resetting force for the release lever is provided by a spring interposed between that other arm and such lateral wall.

In accordance with the invention, the active end of the switching rocker can be constituted by two parallel arms which fit snugly around the latching lever and which form a bearing for the guide projection, and the guide projection is in the form of a pin or axle. This enables the bimetal strip constituting the overload responsive element, and its pivot plane, to also be located in the pivot plane of the switching rocker which favors compact design and makes the switch particularly suitable for use in a row of such switches in major switching systems. This structural arrangement also improves stabilization of the guidance of the latching lever in the switch housing.

In further accordance with preferred embodiments of the invention, in which the active end of the switching rocker effectively terminates in a laterally protruding guide projection which rests on the cam path, and the cam path is defined by a guide groove which is closed on all sides and which guides the projection, a resetting force is applied to the switching rocker to urge it into its breaker opening position, the portion of the cam path of the latching lever between its center dead point projection and the path end associated with the breaker closing position is sloped in such a way that when the detent abutment is moved away from the detent end of the latching lever, that cam path portion extends approximately in the direction of the arc of travel of the active end of the switching rocker, thereby nullifying the detent action which acts on the rocker when in its breaker closing position. This produces automatic raising of the detent end of the latching lever after a trip-free release, unless the switching rocker is externally blocked in its breaker closing position.

When the structure is further arranged to subject the release lever to a resetting force which opposes the release force produced by operation of the overload responsive element and which moves the release lever into a position where the detent abutment can engage the detent end of the latching lever, and so that the release lever has the form of an angular lever having an arm extending approximately parallel to a lateral housing wall, and so that the resetting force is generated by a spring interposed between that arm and that wall, the resulting arrangement has the capability of automatically reestablishing the starting state of the breaker switch for renewed switch-on after a trip-free release has occurred and the bimetal strip has cooled.

A particularly advantageous embodiment of the invention has the form of a two-pole circuit breaker composed of two juxtaposed single-pole switches and operating in the same manner as the above-described single-pole switches but being distinguished by the fact that only a single one of certain significant actuation members, such as the switching rocker, the latching lever and the detent abutment, are provided but are equally effective for both single-pole switches. This two-pole circuit breaker itself is distinguished by its simple and efficient design and its easy installability.

DESCRIPTION OF THE PREFERRED EMBODIMENTS

Initially the structure and operation of a single-pole circuit breaker switch according to the invention will be described and explained with the express mention that the structure and operation of this single-pole switch essentially coincide with the structure and operation of the two single-pole switches of the embodiment according to FIGS. 4–8.

Figure 1:
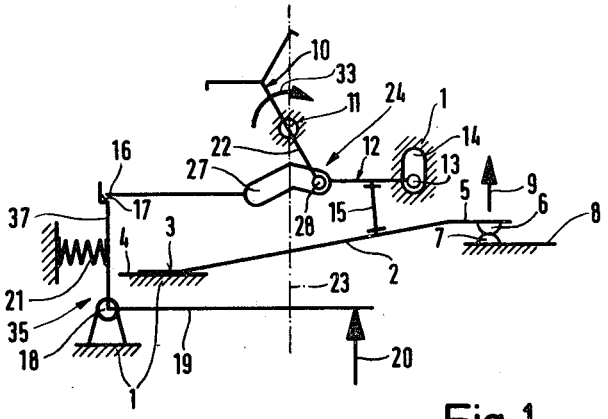
FIG. 1 is a function and kinematic linkage diagram of a single-pole circuit breaker switch according to the invention in the switched-on, or contact closing, position.
Figure 2:
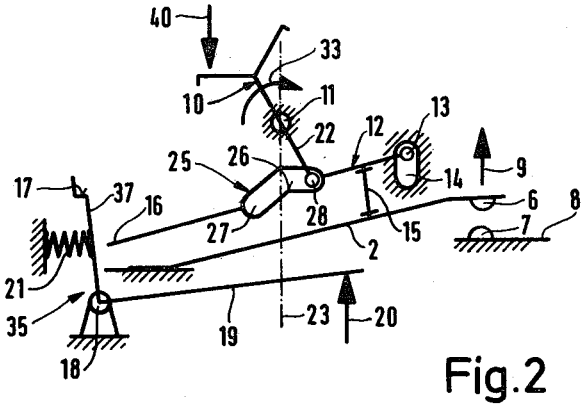
FIG. 2 is a view similar to that of FIG. 1 with the breaker in its contact opening, or switched-off, position after a trip-free release, and with the switching rocker in its breaker closing position.
Figure 3:
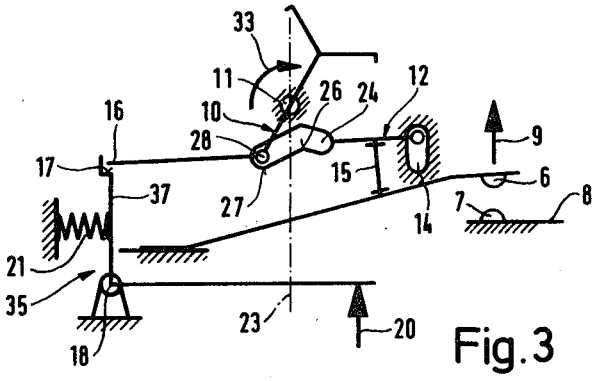
FIG. 3 is a view similar to that of FIGS. 1 and 2 after switch-off and with the switching rocker in its breaker opening position, the state shown in FIG. 3 existing if switch-off occurs by way of pivoting the switching rocker or by trip-free release as a result of a current overload.

Referring thus to FIGS. 1–3, within housing 1 whose pertinent wall portions are indicated by hatching in FIGS. 1–3, a contact spring 2 is fixed via its end 3 to a connecting lug 4 which is permanently secured to the housing wall. At its free end 5, the contact spring 2 carries a movable contact 6 which coacts with a fixed countercontact 7 fastened to a contact lug 8 which is likewise permanently connected to the wall of housing 1. Contacts 6 and 7 constitute the switching point in the circuit to be protected. The contact spring 2 is stressed, or biassed, in the contact breaking direction 9, to enable it to automatically break the connection between contacts 6 and 7.

Above the contact spring 2, a switching rocker 10 for manually operating the breaker is arranged to be pivotal about an axis 11 extending at a right angle to the length of contact spring 2. The axis 11 is fixed in housing 1.

Between contact spring 2 and a switching rocker 10, there is provided a latching lever 12 which extends approximately parallel to the length of contact spring 2. The latching lever 12 is mounted within housing 1 to be pivotal in the pivot plane of the switching rocker 10 and has a contact end 13 which is adjacent the free end 5 of the contact spring and is displaceable approximately in the contact breaking direction 9. For this purpose, there is provided in housing 1 a longitudinal guide 14 for guiding the contact end 13 of latching lever 12.

The latching lever 12 bears against the back of contact spring 2 near the area of contact 6 via an arm 15 which is connected to the latching lever 12. Thus any force exerted on spring 2 to lever 12 is in opposition to contact opening direction 9.

The end 16 of the latching lever 12 which is opposite the contact end 13, end 16 hereinafter being called the detent end, is arranged to rest, when the switch is in the state shown in FIG. 1, on a detent abutment 17 which is disposed, as is contact spring 2 below the latching lever 12. Detent abutment 17 is mounted in housing 1 to be pivotal about an axis 18 which is parallel to axis 11. Abutment 17 is formed at the end of an arm 37, hereinafter called the load arm, of an angular, or bell crank, lever 35 whose other arm, or power arm, 19 is subject to the switch opening force produced in direction 20 by a current overload responsive element, which will be described in detail below. The lever 35, and particularly detent abutment 17, is under the influence of a resetting spring 21 supported at the wall of housing 1 and acting in opposition to the pivoting direction 20. Spring 21 is shown schematically as a compression spring, but can be constituted by another spring type, such as a torsion spring.

While the contact spring 2 and the detent abutment 17 act from the bottom substantially on respective opposite ends of the latching lever 12, the switching rocker 10 acts from the top on approximately the center of latching lever 12. This action takes place via the action end 22 of the switching rocker 10, which end extends radially from, or below, the axis 11.

A line 23 perpendicular to latching lever 12, i.e., perpendicular to the connecting line between contact end 13 and detent end 16, when lever 12 is in the position shown in FIG. 1, passes through axis 11. When rocker 10 is in its breaker closing position, shown in FIGS. 1 and 2, the active end 22 is disposed to the right of line 23, and when rocker 10 is in its breaker opening position, shown in FIG. 3, end 22 lies to the left of line 23. When the breaker is in its switched-on state, in which the detent end 16 of the latching lever 12 rests on the detent abutment 17 and is supported thereby, as shown in FIG. 1, end 22 presses the latching lever 12 into the position in which it acts on contact spring 2 to press contact 6 firmly against contact 7. The closing pressure for the contact spring 2 is thus produced by the active end 22 of the switching rocker 10 and is transferred via the contact end 13 of the latching lever 12.

Latching lever 12 presents a cam path 25 along which a lateral guide protrusion 28 fixed to active end 22 is guided. Cam path 25 presents two detent recesses 24 and 27 and a projection 26 directed toward axis 11 and located between recesses 24 and 27. When the switch is in the switched-on, or contact closing, state shown in FIG. 1, protrusion 28 of the active end 22 of the switching rocker 10 rests in detent recess 24. Recess 24 is thus associated with the breaker closing position of rocker 10. During pivoting of the switching rocker to its breaker opening position, protrusion 28 of the switching rocker moves along cam path 25, past projection 26, into recess 27. Projection 26, which projects toward the axis 11 of the switching rocker, is located at the center dead point position of the active end 22, i.e., approximately at the level of the line 23. The recess 27 in the cam path 25 is associated with the breaker opening position of the switching rocker, faces the detent end 16 of lever 12, and terminates at a greater distance from the axis 11 of the switching rocker than does the detent recess 24.

In the practical embodiment shown in FIGS. 4–7, the lateral guide protrusion 28 is constituted by a pin 39 engaging in a guide groove 29 which is closed on all sides and defines the cam path 25. The guide groove 29 has a generally V shape and the peak 30 of the V, corresponding to projection 26, points toward the switching rocker 10. The branch 31 of the V (FIG. 8), which corresponds to detent recess 27, and which extends toward the detent end 16 of the latching lever 12, is longer than the branch 32 (FIG. 8) of the V which corresponds to recess 24 and which extends toward the contact end 13 of lever 12.

The switching rocker 10 is under the influence of a resetting force which urges it in the direction of the arrow 33 of FIGS. 1–3 and is produced by a torsion spring 34 shown in FIGS. 4–8.

The power arm 19 of angular lever 35, which is acted on by bimetal strips 36 constituting overload responsive elements, extends approximately parallel to the contact spring 2 and/or to the latching lever 12. The power arm 19 has approximately the length of contact spring 2 and/or of the latching lever 12.

The load arm 37 of the angular lever 35 extends approximately parallel an adjacent lateral wall of housing 1. The resetting force acting on the load arm 37 in opposition to the pivoting direction 20 is produced by the resetting spring 21 disposed effectively between the load arm 37 and the wall of housing 1.

The active end 22 of the switching rocker 10 is constituted by two parallel arms 38 which surround the latching lever 12 while resting against its sides and thus guiding it. Arms 38 form a mount for the pin, or axle, 39, corresponding to guide protrusion 28. Pin 39 engages in the guide groove 29 of the latching lever 12.

The two-pole switch embodiment illustrated in FIGS. 4–8 is distinguished by the particularity that the latching lever 12 and the angular lever 35 are disposed between two single-pole circuit breaker switches 41 and 42 provided in housing 1. The latching lever 12 and the angular lever 35 are disposed in a chamber 44 which is separated by housing partitions 43 from switching chambers 45 and 46 of the two single-pole switches. The latching lever 12 contacts the back of both contact springs 2 of the switches by means of a pin, or shaft, 47 which projects on both sides into chambers 45 and 46 in the area of its contact end 13. This bidirectionally protruding pin 47 extends through the contact end 13 of the latching lever 12 and extends parallel to the axis 11 of the switching rocker. This pin 47 is made of electrical insulating material.

After the device has been assembled, pin 39 is trapped between partitions 43 so that it is positively prevented from sliding out of place.

The power arm 19 of the angular lever 35 is provided at its free end with bidirectionally projecting protrusions 48 which extent into the path of displacement of respective bimetal strips 36 associated with the single-pole switches.

The pin 47 has its ends guided in longitudinal grooves 49 and 50 formed in lateral walls of housing 1 and constituting the longitudinal guides 14. In the area of the longitudinal grooves 49, 50 the housing walls are covered by covering walls 51 and 52, made in particular of insulating material so that longitudinal displacement of the pin 47 inserted in housing 1 in its axial direction is prevented. Walls 51 and 52 are covered by cover plates 56 provided with tabs 57 that can hold housing 1 in a breaker panel. The covering walls 51 and 52 and plates 56 are fastened to housing 1 by means of a tubular rivet 53 which is pushed through a hollow shaft 54 forming the pivot bearing of the switching rocker 10 and which is supported in bores 55 formed in the lateral walls of the housing 1.

The connecting lugs 4 project out of the housing and are secured tightly in housing 1 by being twisted. Each bimetal strip 36 is of U-shaped design and is fastened to a respective connecting lug 4 via the end of one of its arms 59 while the end of the other arm 60 of the U is angled and permanently conductively connected with a bimetal strip lead 64 that ends in a connecting lug 61 which is also fixed in the wall of housing 1 by twisting.

The fixed end 3 of each contact spring 2 is welded to a connecting lug 4 to form a conductive connection therewith. Each fixed contact 7 is permanently connected to a contact terminal 62 which forms a one-piece unit with a connecting lug 63 which is likewise fastened in the wall of housing 1 by twisting.

In the two-pole switch embodiment, the bimetal strips 36 are matched in such a manner that deflection of one bimetal strip in response to a current overload is sufficient to pivot the angular lever 35 in direction 20 and thus open both switch poles. If both bimetal strips are being deflected, the release time will be shorter by about 10%.

At the lead 64 to each bimetal terminal 61 there is provided an adjustment screw 65 which itself presses against the bimetal strip via an insulating member 66. Adjustment of screw 65 varies the bias of the bimetal strip and thus influences the release time of the device.

Pin 47, which transfers the contact pressure from the latching lever 12 to the contact springs 2, lies against each spring 2 in the region between its associated contact 6 and fixed end 3 since, during switch-off of the switch by movement of the switching rocker, the guide protrusion, or pin, 39 of the active end 22 of the switching rocker passes over the projection 30 defining the peak of the cam path and thus produces an additional pressure which acts on the latching lever 12 in opposition to the opening direction 9 and which causes the contact spring 2 to snap through.

When the circuit breaker of FIGS. 4–8 is plugged into a breaker panel or other electrical power installation, each current path to be protected is connected in series, or completed, between the lugs 61 and 63 of a respective switching pole. Thus, current flows via a lug 61, lead 64, strip 36, contact spring 2, contacts 6 and 7, lead 62 and lug 63. An auxiliary current path is formed between the lugs 4 and 63 via contact spring 2, contacts 6 and 7. This auxiliary path is not protected by itself but is controlled by movement of the strip 36, i.e., by the protected main current path. For instance the protected main current path feeds an electric motor while the auxiliary current path feeds an electric valve. (see Tx Tergau No. 643/24.4.1978).

Figure 5:
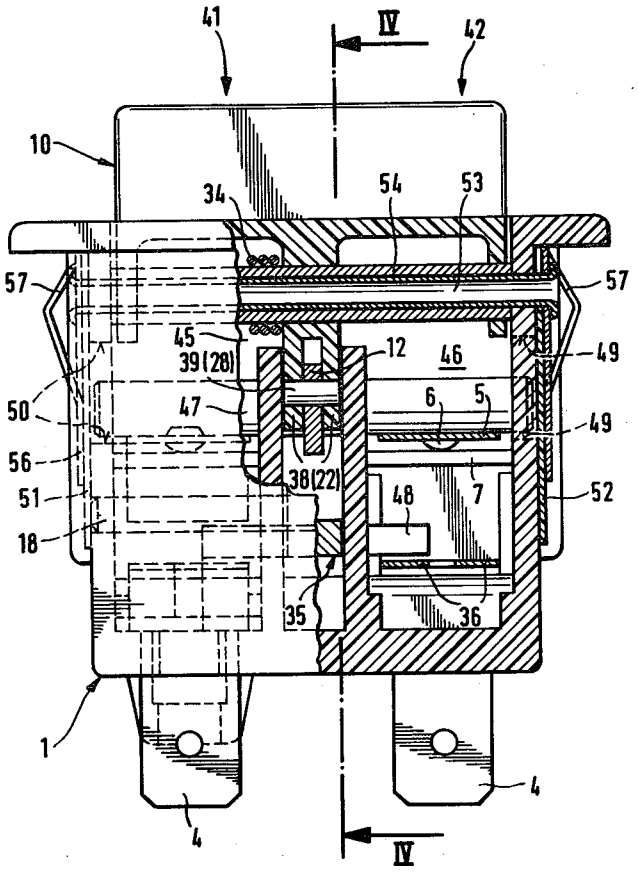
FIG. 5 is a cross-sectional view along the line V—V of FIG. 4.
Figure 4:
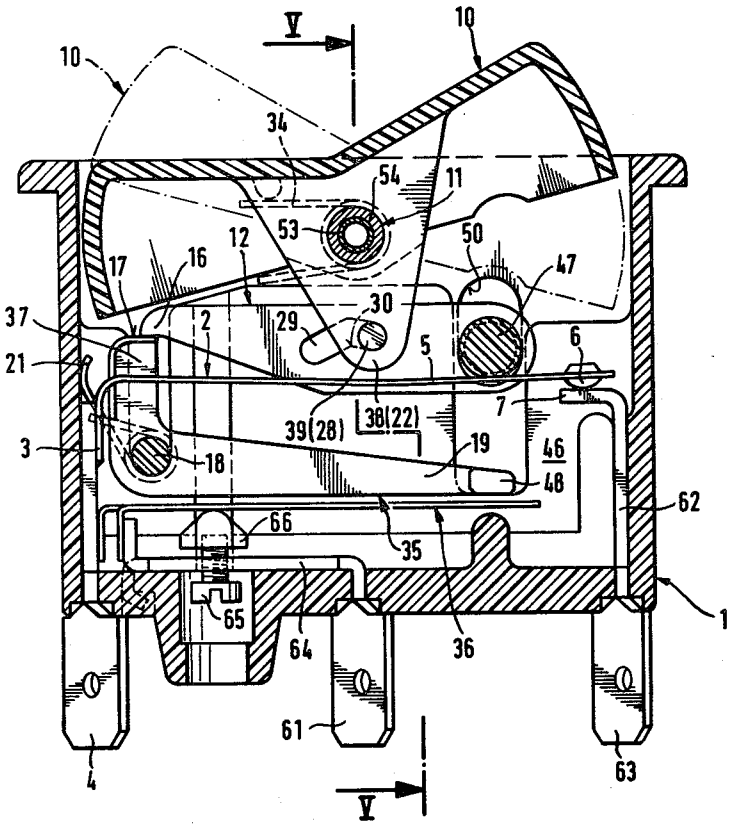
FIG. 4 is an elevational, cross-sectional side view of a preferred embodiment of a two-pole circuit breaker switch, according to the invention, combined of two single-pole switches operating generally as shown in FIGS. 1–3 and in the operating state shown in FIG. 1.

The circuit breaker switch shown in FIGS. 4–8 operates as follows:

With the switch poles initially closed, as shown in FIGS. 4 and 5, the occurrence of a current overload causes the bimetal strip 36 to bend upwardly and, after coming to abut against an associated projection 48 of lever 35, to pivot that lever in the pivoting direction 20. Thus the detent abutment 17 is pivoted away from underneath the detent end 16 of the latching lever 12 which now no longer has a support. Thus the detent end 16 of the latching lever 12 can move downwardly. Since the prestressed contact spring 2 permanently presses upwardly in the contact opening direction 9 against the contact end 13 of latching lever 12, end 13 being guided within longitudinal grooves 49 and 50, the latching lever 12 pivots counterclockwise about the guide pin 39 acting as a fulcrum. The switch is then in the state shown in FIGS. 2 and 7.

This pivoting of lever 12 decreases the slope of the portion of the latching lever cam path between its projection 30 and the end of detent recess 24 or 32, this portion is oriented so that approximately in the direction of the arc of pivotal movement of guide protrusion 28 or pin 39 of the active end 22 of the switching rocker 10 from its breaker closing to its breaker opening position. Thus the detent recess 24, 32 loses its detent function. It no longer prevents the switching rocker 10 from pivoting in the direction of arrow 33 of FIGS. 1–3 back into its breaker opening position, shown in FIGS. 3 and 6, under the influence of torsion spring 34.

Once the guide pin 39 has been guided, in guide groove 29 past projection 30, into detent recess 27, 31, its continued movement simultaneously produces raising of the detent end 16 of the latching lever 12 into its starting position, above abutment 17. Then, after the associated bimetal strip 36 has cooled, the resetting spring 21 pivots angular lever 35 back into its starting position, shown in FIGS. 1, 3 and 4, so that abutment 17 again comes to lie below the detent end 16 of the latching lever 12.

Figure 7:
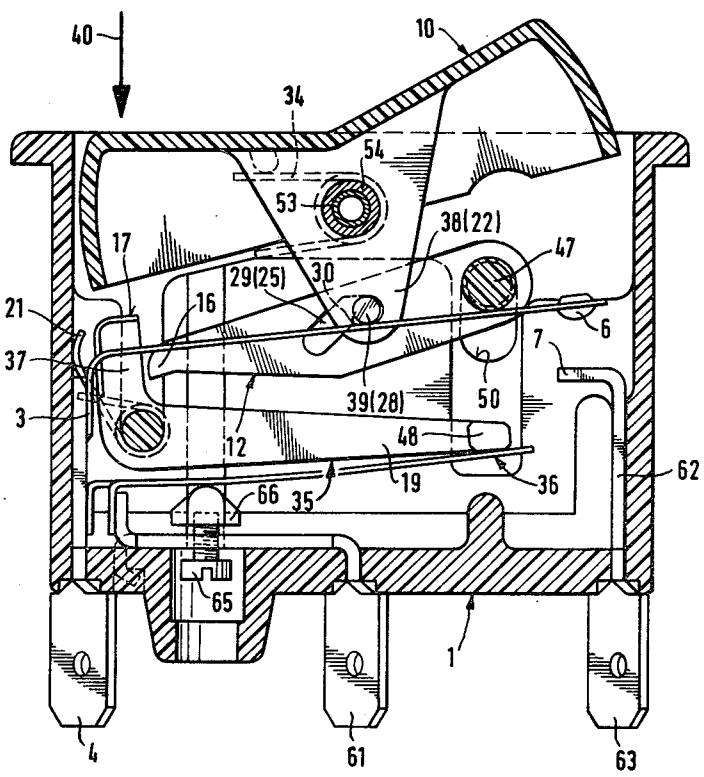
FIG. 7 is a view similar to that of FIGS. 4 and 6 after actuation due to a current overload, i.e. trip-free release, and with the rocker in its breaker closing position.
Figure 6:
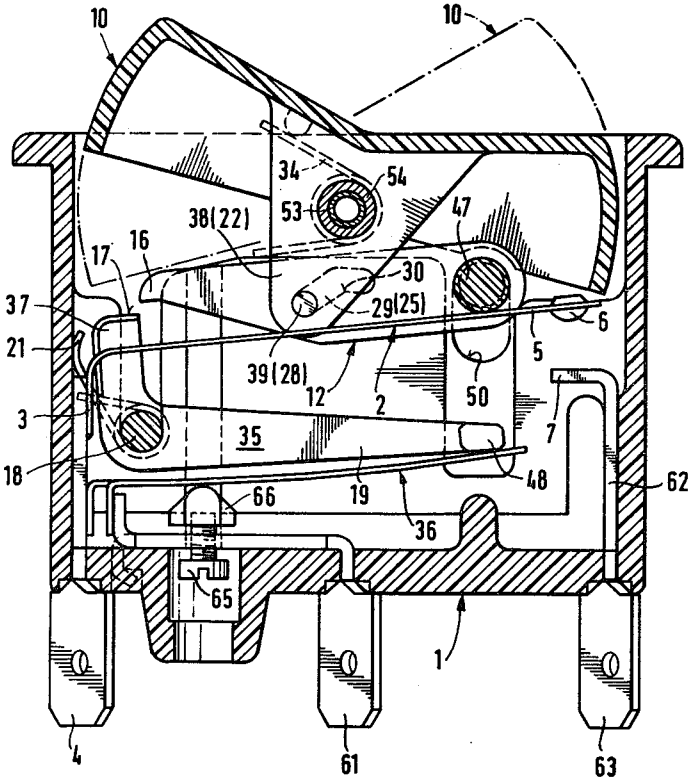
FIG. 6 is a cross-sectional view similar to that of FIG. 4 with the switch in its contact opening, or switched-off, position, where switch-off occurred as a result of a current overload, the switching rocker is in its breaker opening position, and at least one bimetal strip not yet cooled.
Figure 8:
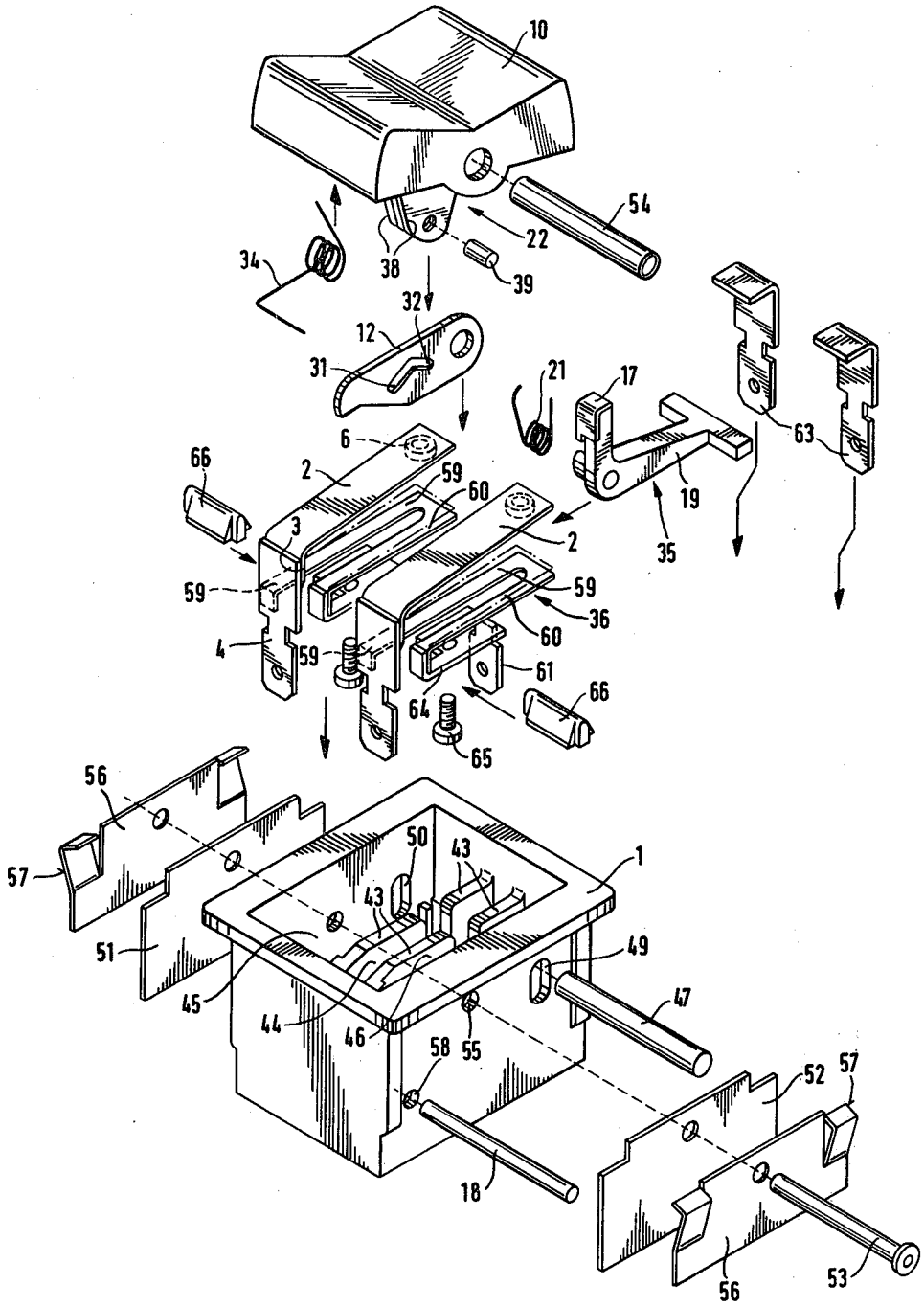
FIG. 8 is an exploded perspective view of the components of the two-pole circuit breaker switch shown in FIGS. 4–7.

To reset the breaker, it is then only necessary to move rocker 10, manually, back into its breaker closing position by application of a force in the direction 40, shown in FIGS. 2 and 7.

If the switching rocker 10 were held in its breaker closing position during a current overload release, as depicted in FIG. 2 by a force in the direction 40, this will not impede the circuit breaker from switching off, i.e., it will effect a trip-free release. The switching rocker 10 is in that case merely prevented from automatically moving from breaker closing position to its breaker opening position, and thus from raising the detent end 16 of the latching lever 12 to its starting position. Of course, rocker 10 must be moved to its breaker opening position before the breaker can be reset.

To the extent that structural features serving to simplify manufacture have been described in connection with the embodiment relating to a two-pole circuit breaker, they can be used analogously as well for a single-pole circuit embodiment without departing from the scope of the invention. The combination of the switching members to effect common release of two separate switches can also be used independently of the structural features of the single-pole switches within the framework of the invention.

It will be understood that the above description of the present invention is susceptible to various modifications, changes and adaptations, and the same are intended to be comprehended within the meaning and range of equivalents of the appended claims.

What is claimed is:

1. In a circuit breaker composed of a contact spring fixed at one end, carrying a movable contact at its free end, and biassed to urge the movable contact away from an associated fixed contact, a switching rocker pivotally mounted to selectively move between a breaker closing position in which it can act on the contact spring to urge the movable contact toward the fixed contact and a breaker opening position in which the rocker permits the contact spring to move the movable contact away from the fixed contact, the switching rocker being mounted to pivot about an axis which extends approximately perpendicular to the length of the contact spring, a release device arranged to be responsive to a current overload and operative to permit the contact spring to move the movable contact away from the fixed contact upon the occurrence of a current overload and independently of the position of the switching rocker, and a housing containing the contact spring, the switching rocker and the release device, the improvement wherein:

said circuit breaker further comprises a latching lever extending approximately parallel, and adjacent, to said contact spring and mounted to be movable in said housing between a contact closing position, and at least one contact opening position, said latching lever having a contact end which faces said free end of said contact spring and which is mounted to be displaceable in approximately the direction of switch opening movement of said movable contact, and having a detent end, which is opposite said contact end, said latching lever bearing against said contact spring in a manner to apply thereto a force which is counter to the direction in which said spring is biassed;

said release device presents a detent abutment movable between a detent position in which said abutment can engage said detent end of said latching lever, and a release position in which said abutment is removed from the path of movement of said detent end;

said switching rocker is disposed at the side of said latching lever which is remote from said contact spring; and said switching rocker includes an active end which protrudes toward said latching lever and which lies, when said rocker is in each of its positions, at a respectively different side of a line extending approximately perpendicular to the length of said latching lever and passing through the pivot axis of said rocker, said active end being operatively associated with said latching lever for moving said latching lever into its contact closing position when said rocker is in its breaker closing position and said detent end of said latching lever is in engagement with said detent abutment.

2. An arrangement as defined in claim 1 wherein said latching lever includes means defining a cam path having at least a first detent recess and said active end of said rocker includes means movable along said cam path to engage in said first detent recess when said rocker is in its breaker closing position.

3. An arrangement as defined in claim 2 wherein said cam path further has a second detent recess engaged by said means at said active end of said rocker when said rocker is in its breaker opening position and a projection located between said recesses and projecting toward said rocker axis, said projection defining the center dead point of the path of pivotal movement of said rocker between its said positions, with said second recess being further from said rocker axis than is said first recess.

4. An arrangement as defined in claim 3 wherein said means at said active end of said rocker comprise a guide member protruding laterally from said active end, and said cam path is constituted by a guide groove formed in said latching lever and closed on all sides in order to retain said guide member.

5. An arrangement as defined in claim 4 further comprising means applying a resetting force to said rocker for urging it into its breaker opening position.

6. An arrangement as defined in claim 4 wherein said guide groove has a V-shaped form, with each detent recess being in a respective side, and the projection constituting the apex of the V-shape, and that side of the V-shape which faces said detent end of said latching lever being longer than the side of the V-shape which faces said latching lever contact end.

7. An arrangement as defined in claim 6 wherein said release device comprises: a release lever which is pivotal about an axis parallel to said rocker axis and which has said detent abutment formed at one of its ends; and a bimetal strip arranged to pivot said lever in a direction to move said abutment into its release position upon occurrence of a current overload.

8. An arrangement as defined in claim 7 wherein said release device further comprises means applying to said lever a restoring force acting in opposition to the force produced by said bimetal strip and urging said lever in a direction to bring said detent abutment into its detent position.

9. An arrangement as defined in claim 8 wherein said release lever is an angular lever having two arms, one said arm carrying said detent abutment and the other said arm being disposed to be acted upon by said bimetal strip and extending approximately parallel to at least one of said contact spring and latching lever.

10. An arrangement as defined in claim 9 wherein said other arm of said angular lever has approximately the same length as at least one of said contact spring and latching lever.

11. An arrangement as defined in claim 9 wherein said one of said angular lever extends approximately parallel to a lateral wall of said housing and said means applying a restoring force comprise a restoring spring interposed between said one arm of said angular lever and the lateral housing wall.

12. An arrangement as defined in claim 9 wherein said bimetal strip extends approximately parallel to said other arm of said angular lever.

13. An arrangement as defined in claim 4 wherein said active end of said switching rocker comprises two parallel arms closely enclosing said latching lever and supporting said guide member.

14. An arrangement as defined in claim 2 wherein said cam path has a projection which projects toward said rocker axis, is spaced from said first detent recess, and is located between the ends of said cam path, and the portion of said cam path between said first detent recess and said projection is sloped in such a manner that when said detent abutment is in its release position, that portion of said cam path extends approximately along the arc of travel of said means at said active end of said rocker, thereby removing any detent action on said rocker when it is in its breaker closing position and said detent abutment is in its release position.

15. An arrangement as defined in claim 1 wherein:

there are two of said contact springs spaced laterally apart and each carrying a respective movable contact at its free end and arranged to cooperate with an associated fixed contact, such that each said spring and its associated movable and fixed contacts constitutes a single-pole circuit breaker unit; said latching lever and detent abutment are disposed between said units; said latching lever comprises two bearing members located at its contact end, projecting laterally to respectively opposite sides thereof and each bearing against a respective one of said contact springs; and said release device comprises two bimetal strips each associated with a respective breaker unit and each movable in a direction to move said detent abutment into its release position upon occurrence of a current overload, and a release lever which is pivotal about an axis parallel to said rocker axis and having a lever arm provided with two members projecting laterally to respectively opposite sides thereof, each said lever arm member being located in the path of movement of a respective one of said bimetal strips.

16. An arrangement as defined in claim 15 wherein: said housing comprises partition means dividing the interior of said housing into two laterally spaced breaker unit chambers each containing a respective one of said units, and a further chamber located between said breaker unit chambers; and said latching lever and release lever are disposed in said further chamber.

17. An arrangement as defined in claim 15 further comprising means defining two opposed, aligned elongate slots extending in the direction in which said latching lever contact end is displaceable, and said bearing members of said latching lever are constituted by rod members whose ends engage in said elongate slots, whereby said elongate slots cooperate with said rod members to guide and limit the movement of said latching lever contact end.

18. An arrangement as defined in claim 17 wherein said rod members are constituted by a shaft which passes through said latching lever contact end and extends parallel to the axis of said switching rocker.

19. An arrangement as defined in claim 18 wherein said shaft is made of an electrical insulating material.

20. An arrangement as defined in claim 17 wherein said slots are formed in, and extend through, opposed lateral walls of said housing, and further comprising: two external, electrical insulating covering walls each covering a respective lateral housing wall provided with one said slot; a hollow shaft supporting, and providing a pivot bearing for, said switching rocker and passing through said housing; and a rivet passing through said covering walls, said lateral housing walls which are covered thereby and said hollow shaft for holding said covering walls to said housing and supporting said switching rocker, the axis of said rivet defining the pivot axis of said rocker.

* * * * *